US006185915B1

(12) United States Patent
Chang

(10) Patent No.: US 6,185,915 B1
(45) Date of Patent: Feb. 13, 2001

(54) FRUIT-PACKAGING MACHINE

(76) Inventor: Kuo-Hsing Chang, 45, Sec. 1 Chian-Kuo Rd., Min-Hsiang Hsiang, Chia-Yi Hsien (TW)

( * ) Notice: Under 35 U.S.C. 154(b), the term of this patent shall be extended for 0 days.

(21) Appl. No.: 09/288,608

(22) Filed: Apr. 9, 1999

(51) Int. Cl.[7] ..... B65B 9/06

(52) U.S. Cl. ..... 53/568; 53/551; 53/374.8; 53/552

(58) Field of Search ..... 53/567, 568, 551, 53/552, 554, 371.8, 374.8

(56) References Cited

U.S. PATENT DOCUMENTS 3,238,692 * 3/1966 Montouri ..... 53/552
3,552,081 * 1/1971 Leasure ..... 53/552
3,738,080 * 6/1973 Reil ..... 53/551
3,889,449 * 6/1975 Membrino ..... 53/374.8
4,079,662 * 3/1978 Pucetti ..... 53/552
5,054,270 * 10/1991 McMahon ..... 53/552

FOREIGN PATENT DOCUMENTS 321163 11/1997 (TW) .

* cited by examiner

*Primary Examiner*—John Sipos
(74) *Attorney, Agent, or Firm*—Larson & Taylor, PLC

(57) ABSTRACT

A fruit-packaging machine includes a plastic bag web outputting device mounted to a frame for supplying a plastic bag web that is enclosed at two lateral sides thereof when it passes through a side-enclosing device. A fruit-conveying device conveys fruit to be packaged into a plastic tube that is then enclosed by a final enclosing device. An operative plate is secured to an enclosing seat of the final enclosing device. The operative plate is operably connected to an actuating plate that pivots a shaft extension of a pivotal shaft by a follower rod. A receiving plate is connected to the pivotal shaft to pivot therewith, thereby receiving the packaged fruit and conveying the packaged fruit to a conveyor.

2 Claims, 10 Drawing Sheets

FRUIT-PACKAGING MACHINE

BACKGROUND OF THE INVENTION

1. Field of the Invention

The present invention relates to a fruit-packaging machine with fruit damage prevention.

2. Description of the Related Art

Applicant's Taiwan Utility Model Publication No. 321163 issued on Nov. 21, 1997 discloses a fruit-packaging machine that comprises a frame for rotatably supporting a plastic bag reel. A side-enclosing device encloses two lateral sides of a plastic web wound around the plastic bag reel. A fruit conveyor conveys fruit into the plastic bag web that has been enclosed in one end and the lateral sides, and a final enclosing device produces the final enclosing of the open end of the plastic bag and cuts the enclosed plastic bag from the plastic bag web.

In the above-mentioned patent, the packaged fruit falls on a conveyor 47 located at a bottom of the machine. However, the packaged fruit tends to be damaged when it falls on the conveyor as it falls through a considerable distance before it reaches the conveyor 47. Although a height-adjusting seat 46 is provided to change the distance between the conveyor 47 and enclosing seats 43 of the final enclosing device, the problem is still remains.

The present invention is intended to provide an improved fruit-packaging machine that mitigates and/or obviates the above problem.

SUMMARY OF THE INVENTION

It is a primary object of the present invention to provide an improved fruit-packaging machine that includes a pivotal receiving plate for receiving the packaged fruit in a manner that the packaged fruit may be conveyed to the conveyor in a sliding way to thereby avoid damage as a result of falling.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
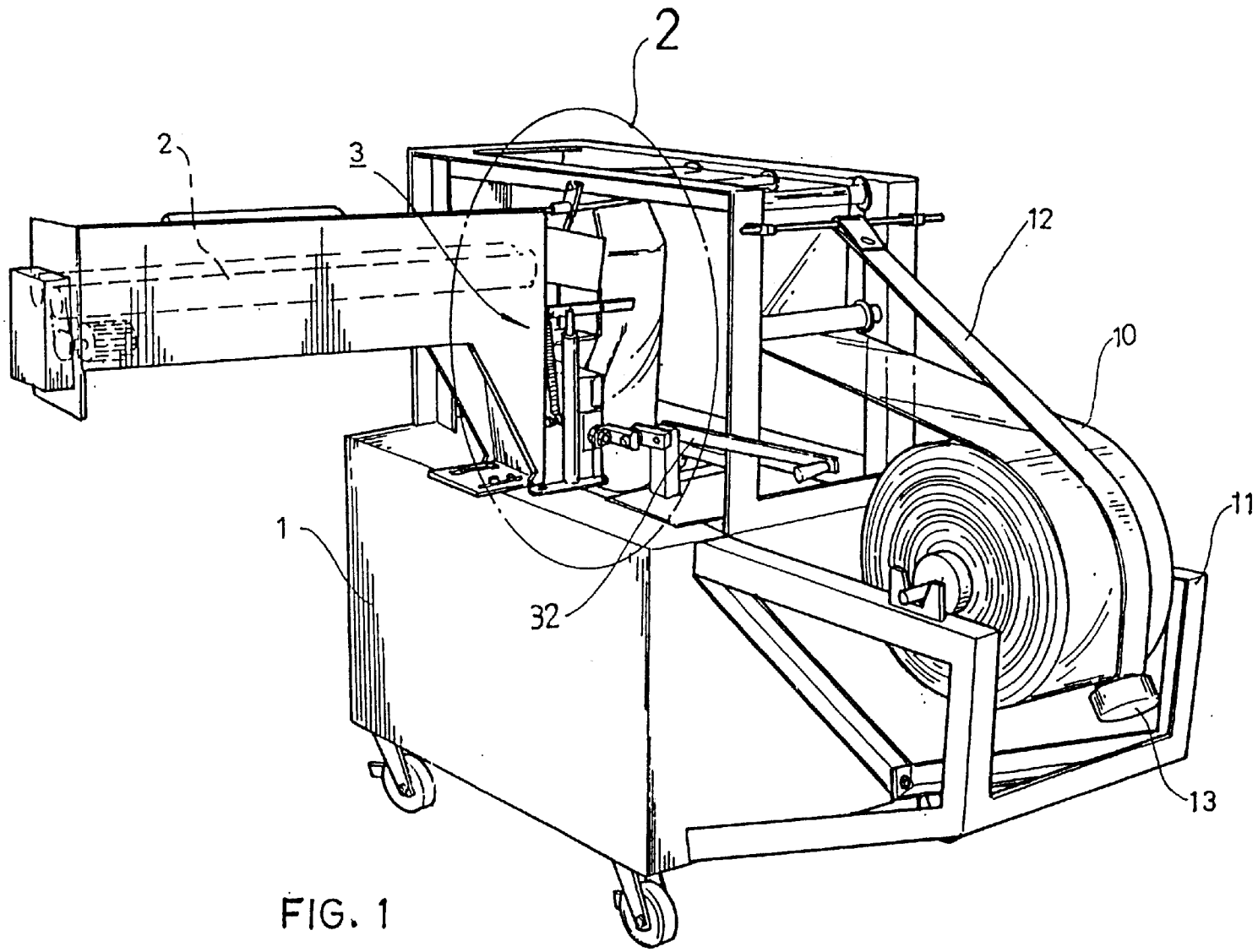
FIG. 1 is a perspective view of a fruit-packaging machine in accordance with the present invention.

Referring to FIG. 1, a fruit-packaging machine in accordance with the present invention generally includes a frame 1, a fruit-conveying device 2, a side-enclosing device 3, a final enclosing device 4, and a receiving plate 5.

The frame 1 includes brackets 11 for rotatably supporting a plastic bag reel (not labeled) around which a plastic bag web 10 is wound. A pressing belt 12 with a weight 13 attached to a lower end thereof is applied to provide a pressing force to the web 10 to thereby avoid undesired rotational movement of the web 10. Thus, the web 10 may be gradually released.

The fruit-conveying device 2, the side-enclosing device 3, and the final enclosing device 4 are mounted in the frame 1.

Figure 2:
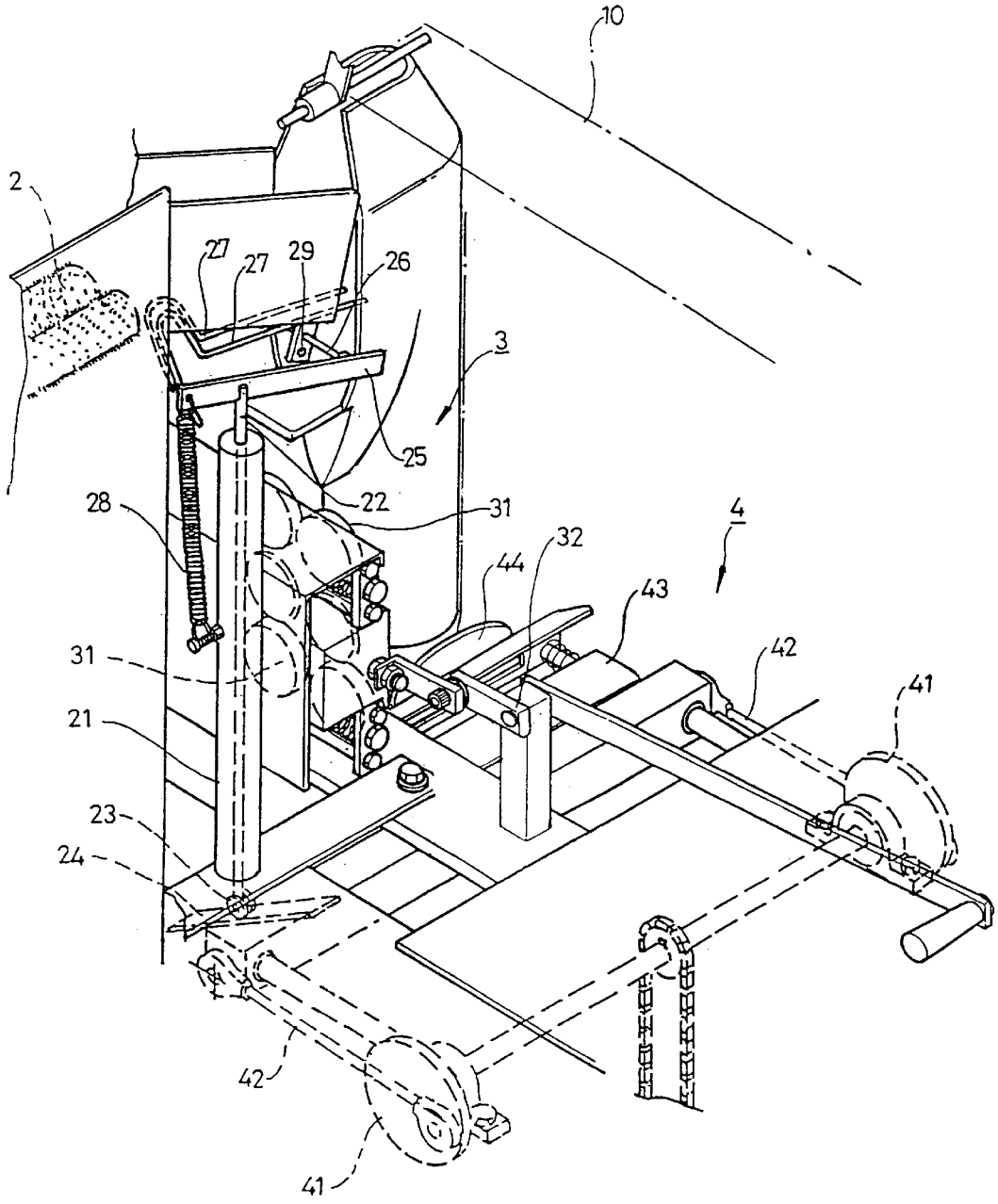
FIG. 2 is an enlarged perspective view of a portion of the fruit-packaging machine in accordance with the present invention, illustrating a fruit-conveying device of the machine.
Figure 3:
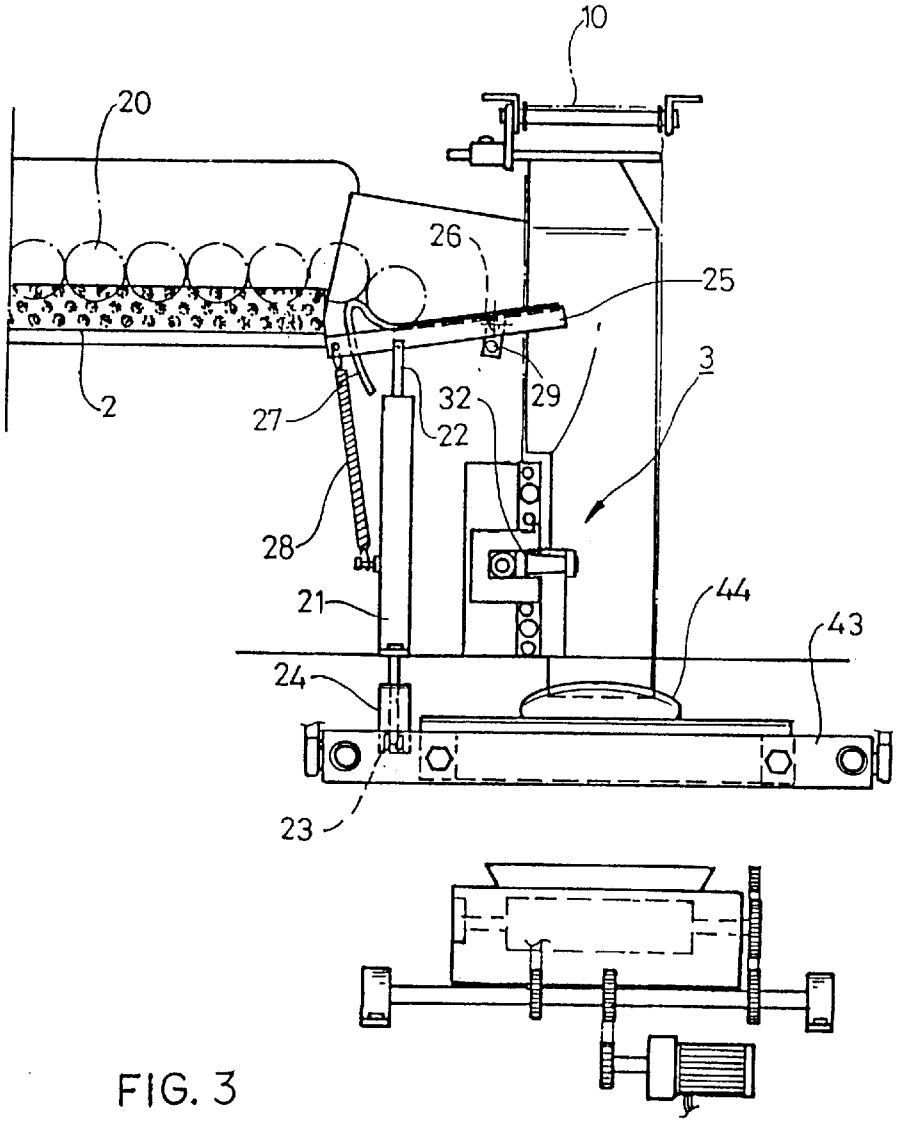
FIG. 3 is a side view of a portion of the fruit-packaging machine in accordance with the present invention.
Figure 4:
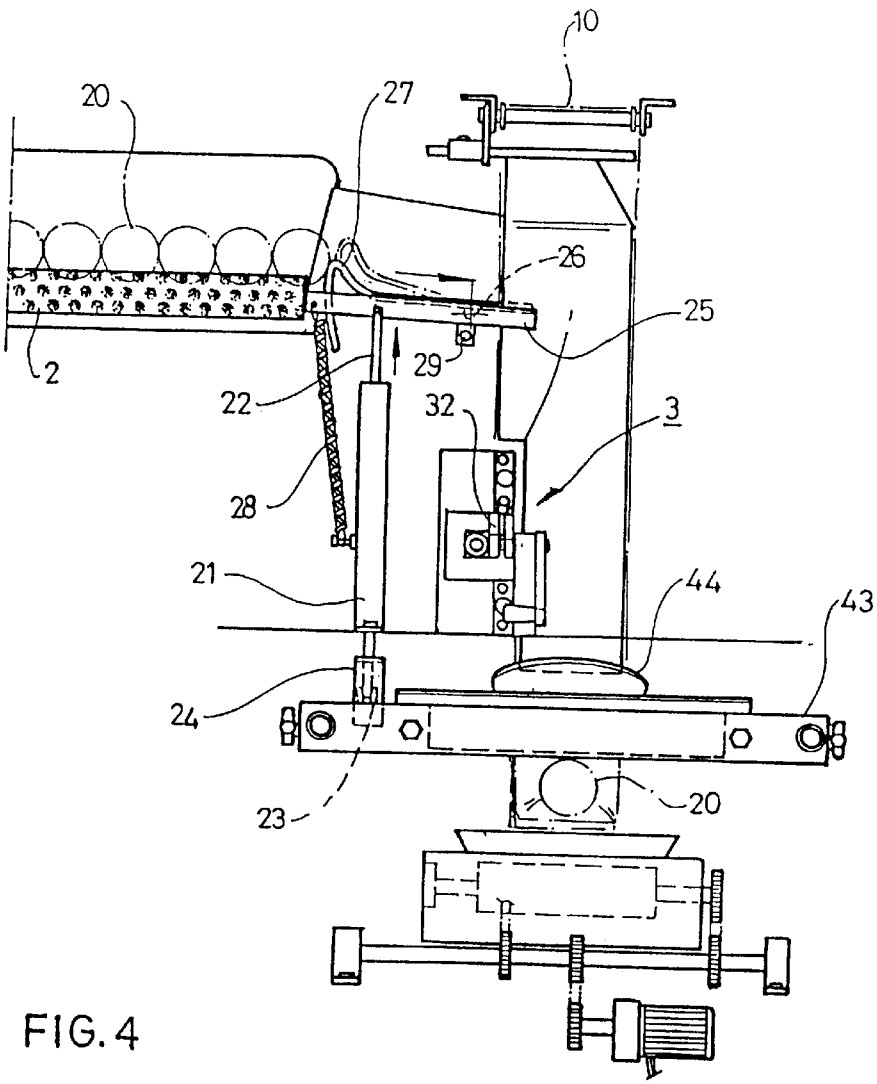
FIG. 4 is a side view similar to FIG. 3, illustrating feeding of fruit.

Referring to FIGS. 2 and 3, the fruit-conveying device 2 may be empowered by a power source or arranged in an inclined manner to release fruit 20 one by one. The fruit-conveying device 2 includes a tappet 22 movably guided in a guide tube 21 along a vertical direction. A roller wheel 23 is attached to a lower end of the tappet 22 and rests on an inclined plate 24 that is secured to a member (not labeled) of the final enclosing device 4. Thus, when the member of the final enclosing device 4 moves, the roller wheel 23 slides along the inclined plate 24 and thus causes vertical movement of the tappet 22; An actuating plate 25 is connected to an upper end of the tappet 22, wherein an end of the actuating plate 25 is connected to a fruit carrier 27 via a rod 26. An end of an elastic element 28 is attached to the other end of the actuating plate 25. In addition, the fruit carrier 27 pivots about an axle 29. The fruit carrier 27 is arranged to receive only one of the fruits and prevent entrance of another fruit. When the tappet 22 moves upward (FIG. 4), the fruit falls into a plastic bag that has been enclosed at two lateral sides and a bottom side thereof.

Referring to FIGS. 2 and 3, the side-enclosing device 3 draws the plastic bag web 10 and encloses the two lateral sides of the plastic bag web 10 by a plurality of enclosing rollers 31 by means of heat generated by electricity. Thus, the lateral sides of the plastic bag web 10 that pass through the enclosing rollers 31 are enclosed. When the enclosing rollers 31 are in a non-operating condition, the enclosing rollers 31 may be separated from each other to avoid sticking of the plastic bag web 10 by means of operating a lever arm 32.

Figure 5:
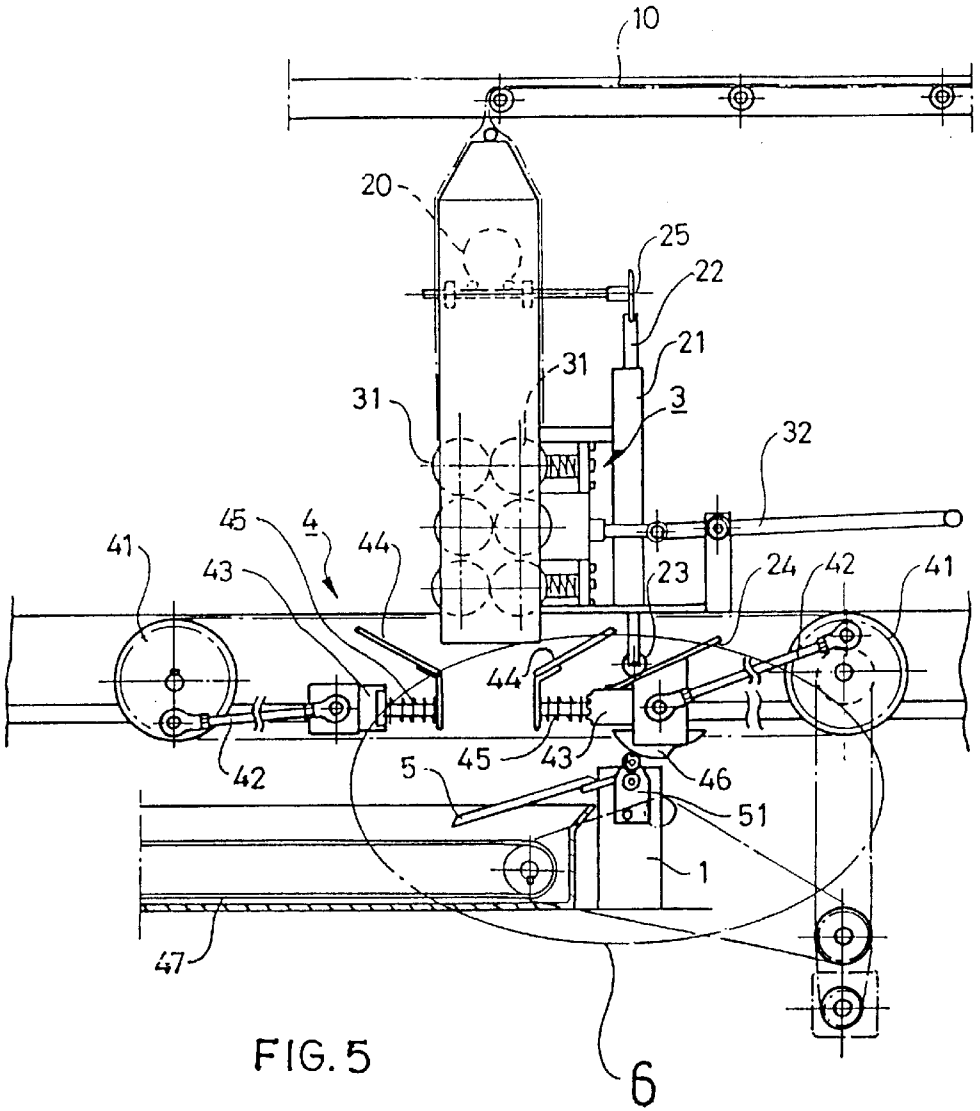
FIG. 5 is a sectional view taken along line 5—5 in FIG. 3.
Figure 6:
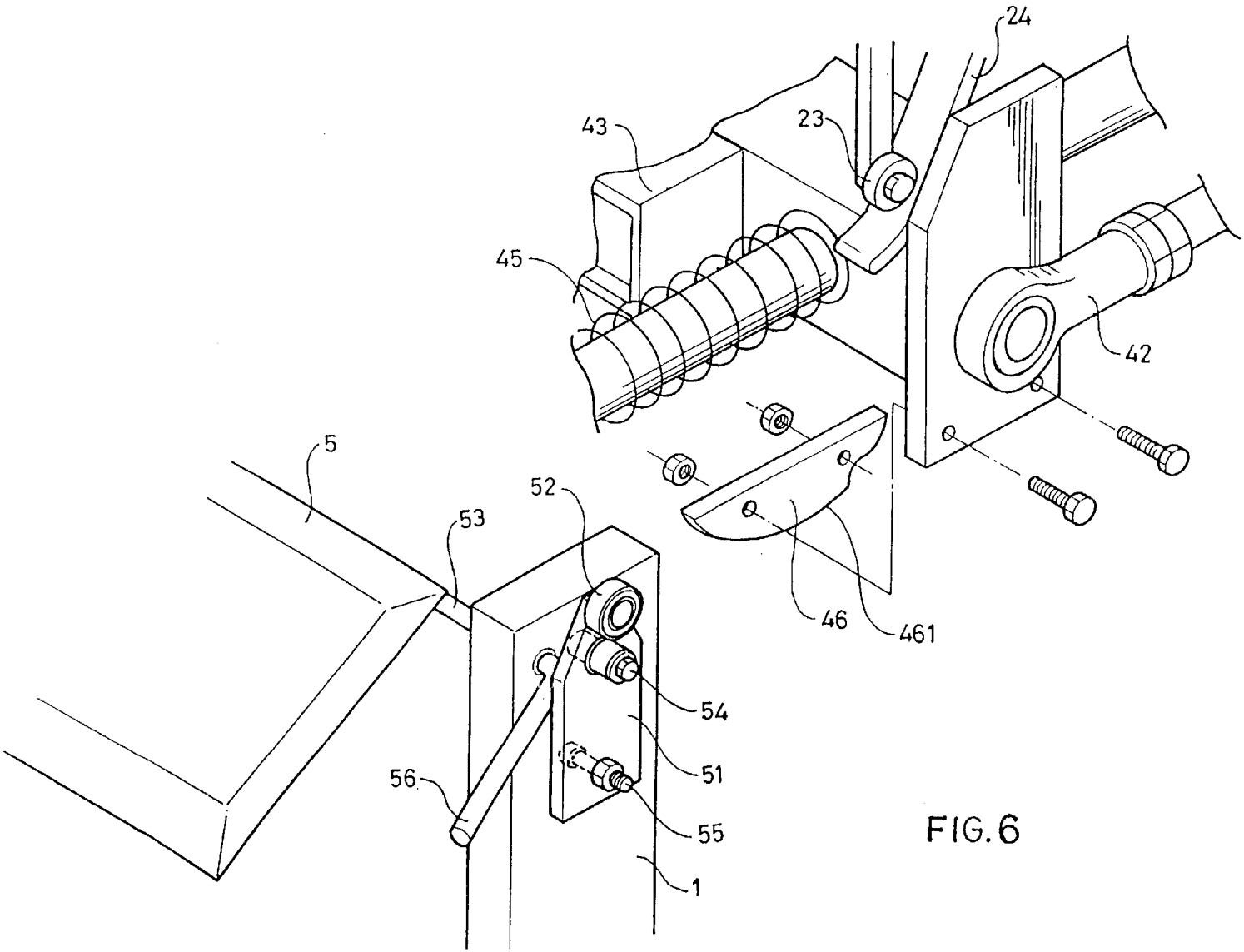
FIG. 6 is an enlarged perspective view illustrating a pivotal receiving plate and corresponding arrangement of the fruit-packaging machine.
Figure 7:
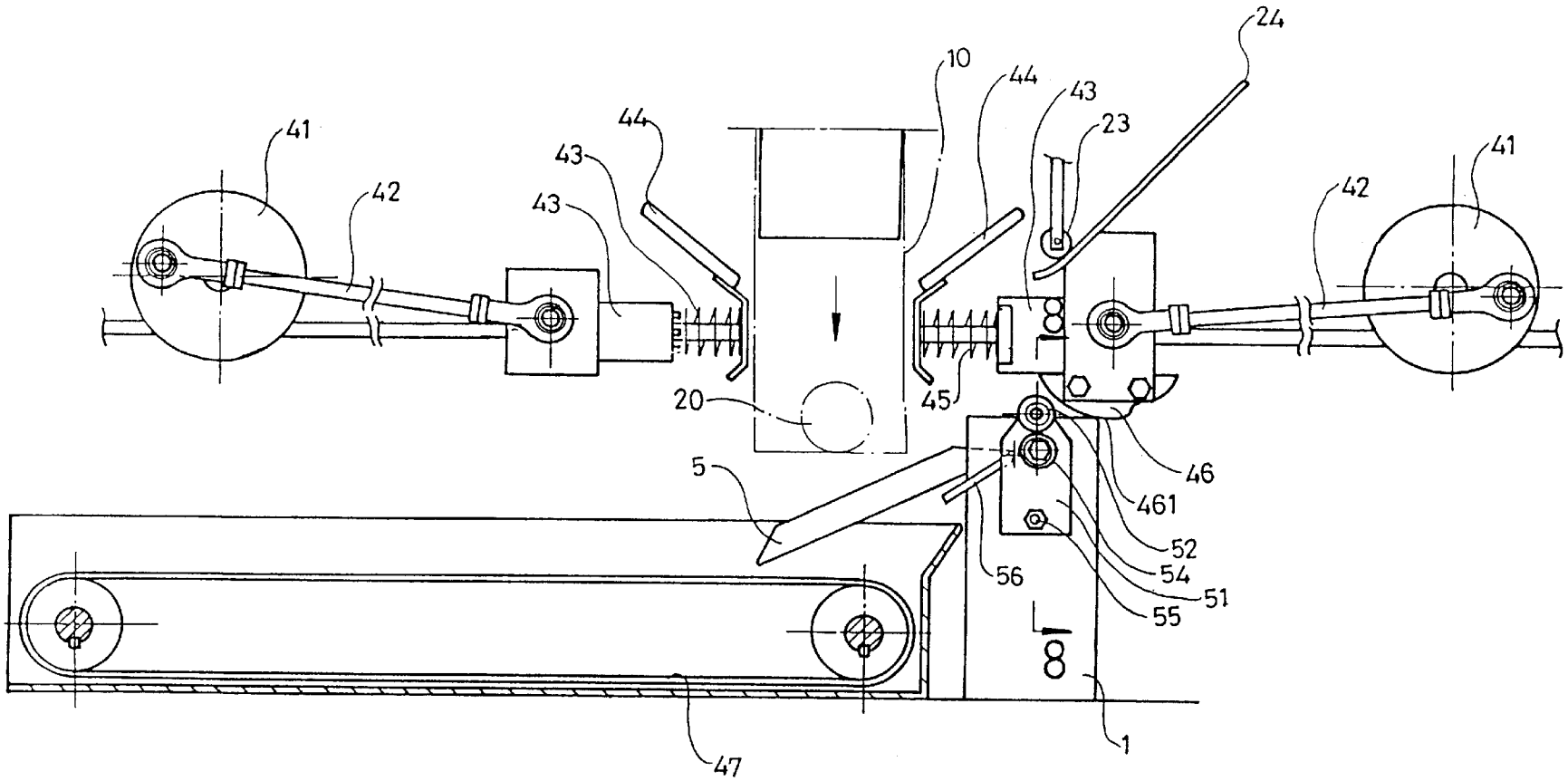
FIG. 7 is an enlarged front view illustrating a final enclosing device, the pivotal receiving plate, and a conveyor for packaged fruit of the fruit-packing machine.
Figure 8:
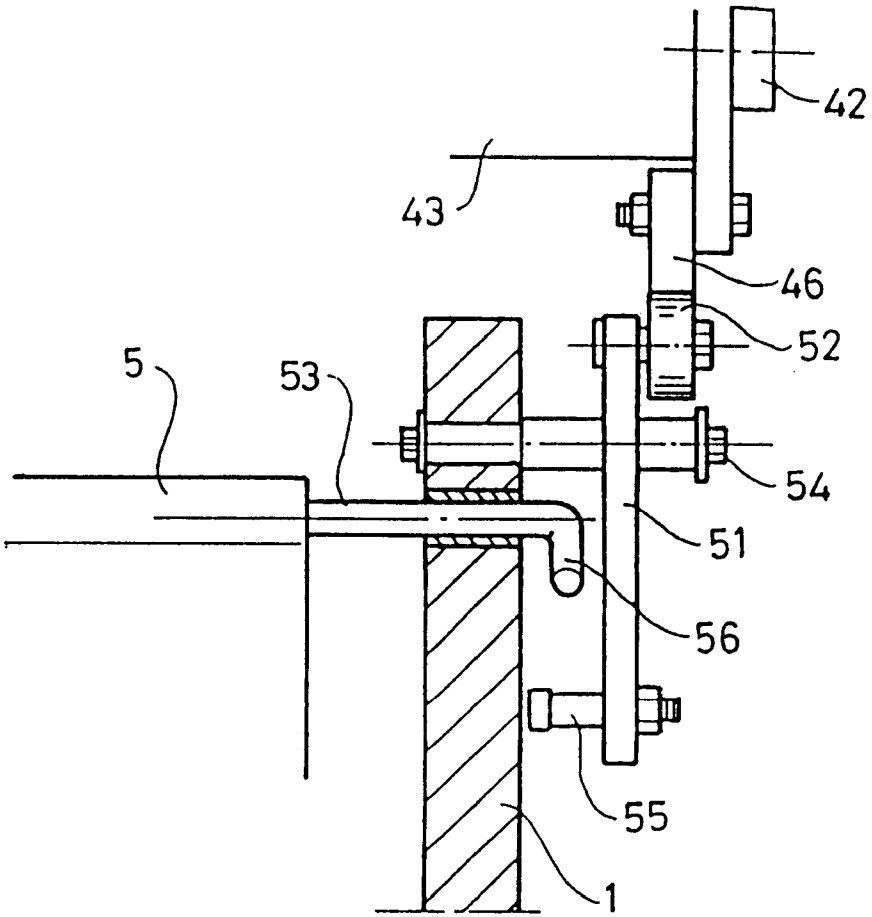
FIG. 8 is a sectional view taken along line 8—8 in FIG. 7.

Referring to FIGS. 2 and 5, the final enclosing device 4 includes two sets of eccentric wheel assemblies 41 that are driven to rotate. Each eccentric wheel assembly 41 drives a crank 42 to actuate an enclosing seat 43 to be in contact with the enclosing seat 43 of the other eccentric wheel assembly 41. One of the enclosing seats 43 may be heated to enclose the plastic bag passing therethrough and cut the enclosed plastic bag. In order to prevent sticking of the plastic bag to the enclosing seat 43, a separation plate 44 biased by an elastic element 45 is mounted to a front end of each enclosing seat 43 such that the separation plate 44 is biased to move outward to peel off the plastic bag stuck to the enclosing seat 43, thereby completing the enclosing and cutting motions.

When the enclosing seats 43 move toward each other under actuation of the cranks 42 of the eccentric wheel assemblies 41, the inclined plate 24 secured to one of the enclosing seats 43 urges the tappet 22 to move upward. In this case, the separation plates 44 approach each other to enclose the plastic bag. At the same time, another one of the fruits that falls as a result of the upward movement of the tappet 22 is stopped by and rests between the separation plates 44 for next package. When the separation plates 44 move away from each other, the packaged fruit falls on the receiving plate 5, while said another one of the fruits 44 falls into the plastic bag that has been enclosed in the lateral sides and the bottom side for final enclosing. The packaged fruit that falls on the receiving plate 5 then slides and falls to a conveyor 47.

Referring to FIGS. 5 through 8, an operating plate 46 is connected to a bottom of the enclosing seat 43 actuated by the crank 42. The operating plate 46 includes a lobe portion 461 for bearing against a rotating wheel 52 mounted to an actuating plate 51.

Figure 9:
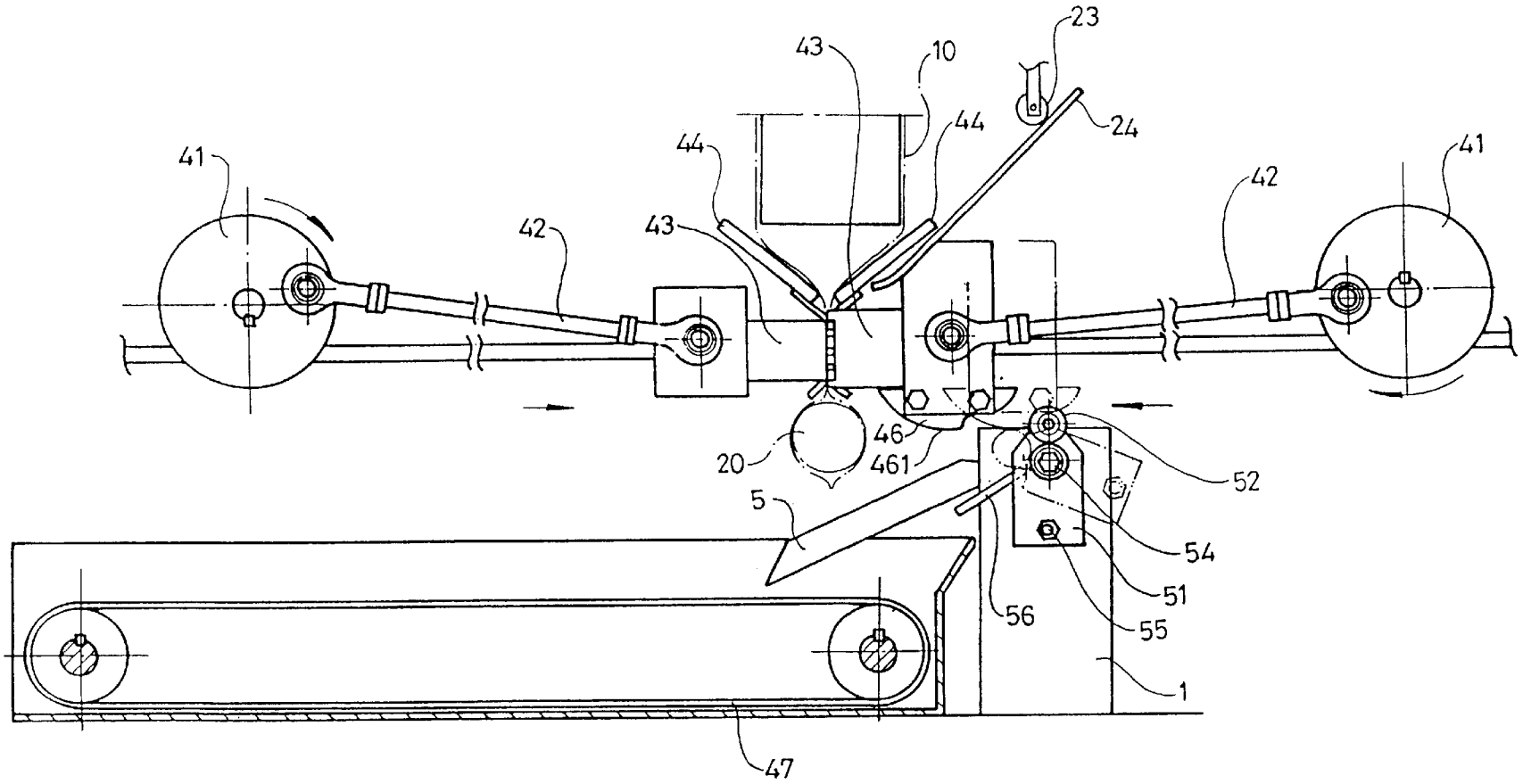
FIG. 9 is a view similar to FIG. 7 illustrating final enclosing for packaging fruit.
Figure 10:
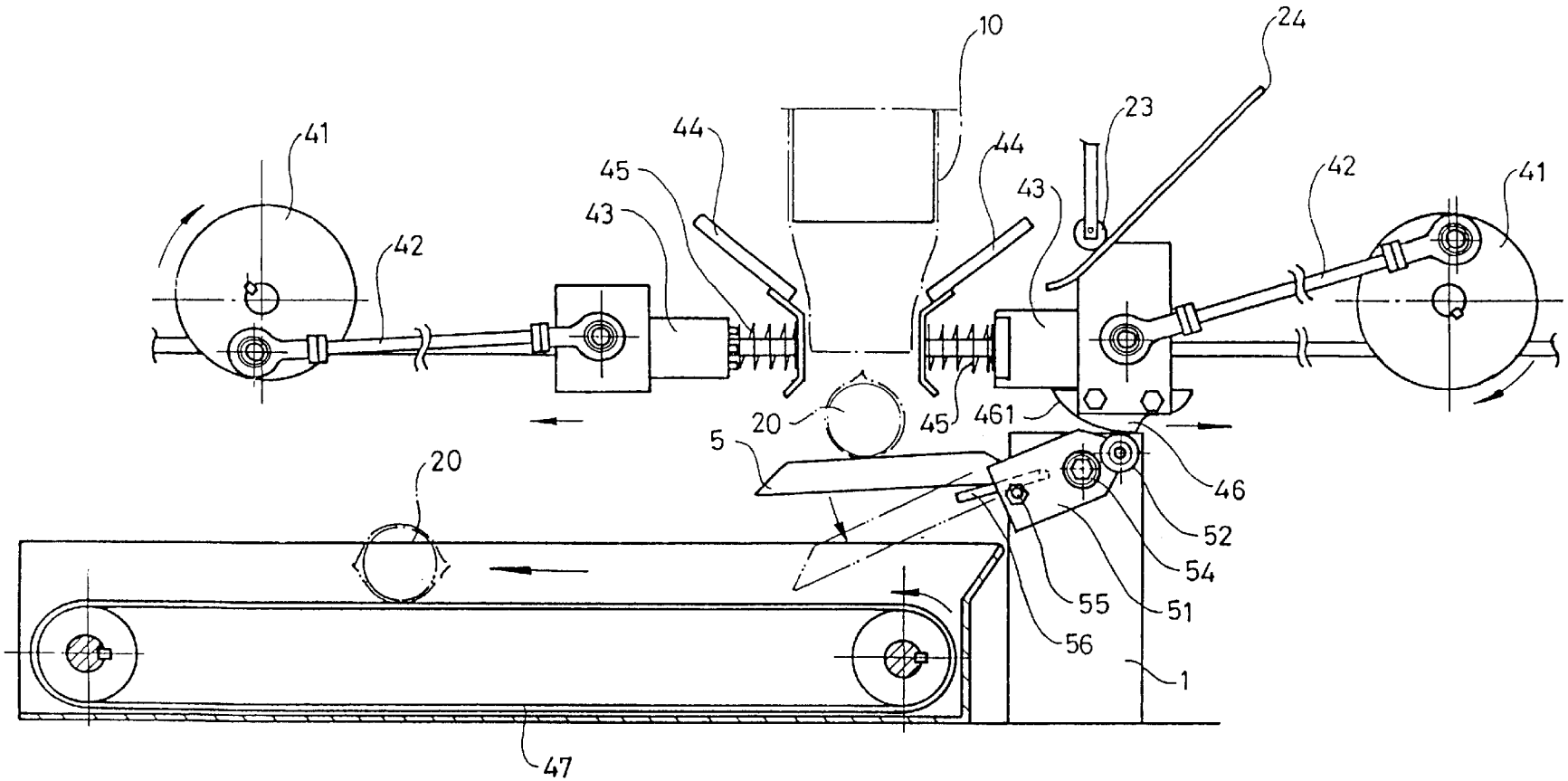
FIG. 10 is a view similar to FIG. 9, illustrating pivotal movement of the pivotal plate for receiving the packaged fruit to avoid damage of the package fruit.

The receiving plate 5 is pivotally mounted between two walls (not labeled) of the frame 1 by a pivotal shaft 53. The actuating plate 51 is pivotally mounted to one of the walls by an axle 54, and the rotating wheel 52 is rotatably mounted to the actuating plate 51. When the enclosing seat 43 moves, the operating plate 46 secured to the bottom of the enclosing seat 43 bears against the rotating wheel 52 such that the actuating plate 51 pivots about the axle 54 (as shown in FIGS. 9 and 10), whereby a follower rod 55 on the actuating plate 51 actuates a shaft extension 56 extended from the pivotal shaft 53, thereby causing pivotal movement of the receiving plate 5 to a position for receiving the packaged fruit, as shown in FIGS. 9 and 10.

According to the above description, it is appreciated that the receiving plate 5 is pivotally moved upward and downward by means of reciprocal movements of the enclosing seats 43 actuated by the cranks 42, thereby timely receiving the packaged fruit and conveying the packaged fruit to the conveyor 47. Thus, the falling distance of the packaged fruit to the conveyor 47 is shortened. As a result, the impact to the falling packaged fruit is reduced to reduce damage to the packaged fruit, thereby providing packaged fruits of better quality Although the invention has been explained in relation to its preferred embodiment, it is to be understood that many other possible modifications and variations can be made without departing from the spirit and scope of the invention as hereinafter claimed.

What is claimed is:

1. A fruit-packaging machine comprising:

a frame;

a plastic bag web outputting device mounted to the frame which supplies a plastic bag web;

a side-enclosing device which encloses two lateral sides of the plastic bag web to form a tubular structure;

a fruit-conveying device which conveys fruit to be packaged to the tubular structure that has been enclosed at a bottom side thereof;

a final closing device comprising two eccentric wheel assemblies, each said eccentric wheel assembly including a crank and an enclosing seat reciprocated by the crank, said enclosing seats enclosing and cutting the tubular structure at a top side thereof above the fruit to release a sealed bag of fruit from a succeeding tubular structure;

an operative plate secured to a bottom of one of the enclosing seats;

a receiving plate located under the final closing device and pivotally connected to the frame by a pivotal shaft, the pivotal shaft including a shaft extension; and an actuating plate pivotally mounted to the frame by an axle parallel to and spaced from the pivotal shaft, the actuating plate including a rotating wheel mounted thereon and a follower rod, such that the rotating wheel is operably engaged by the operative plate secured to the enclosing seat as the enclosing seats are reciprocated causing the actuating plate to pivot about the axle, which pivoting of the actuating plate in turn causes the shaft extension of the pivotal shaft to be engaged by the follower rod on the pivoting actuating plate in order to raise the receiving plate for reception thereon of the sealed bag as the sealed bag is released by the enclosing seats.

2. A fruit-packaging machine as claimed in claim 1, wherein said operative plate includes a lobe portion, and the lobe portion engages the rotating wheel as the enclosing seats are reciprocated.

* * * * *